US005334049A

United States Patent [19]

Kachlic et al.

[11] Patent Number: 5,334,049

[45] Date of Patent: Aug. 2, 1994

[54] HOLD-DOWN CLIP FOR BOARD MOUNTED ELECTRICAL CONNECTOR AND METHOD OF USE

[75] Inventors: Jerry D. Kachlic, Milpitas, Calif.; Toh S. Kiat, Singapore, Singapore

[73] Assignee: Molex Incorporated, Lisle, Ill.

[21] Appl. No.: 61,132

[22] Filed: May 13, 1993

[51] Int. Cl.[5] ..... H01R 13/627

[52] U.S. Cl. ..... 439/567; 439/552

[58] Field of Search ..... 439/552, 554, 557, 564, 439/567, 571, 82, 83, 84; 248/505

[56] References Cited

U.S. PATENT DOCUMENTS

| | | | |
|---|---|---|---|
| 4,006,872 | 2/1977 | Tanner | 439/557 X |
| 4,575,038 | 3/1986 | Moore | 248/505 |
| 4,865,555 | 9/1989 | Assini et al. | 439/82 |
| 4,884,336 | 12/1989 | Waters et al. | 29/845 |
| 5,104,339 | 4/1992 | Verhoeven | 439/567 |
| 5,108,308 | 4/1992 | Northcraft et al. | 439/555 |
| 5,238,413 | 8/1993 | McCaffrey et al. | 439/571 X |
| 5,244,413 | 9/1993 | Clark | 439/567 |

FOREIGN PATENT DOCUMENTS

| | | | |
|---|---|---|---|
| 1506222 | 12/1967 | France | 439/557 |
| 63-116975 | 7/1988 | Japan | H01R 9/09 |
| 64-55674 | 4/1989 | Japan | H01R 9/09 |

*Primary Examiner*—Eugene F. Desmond
*Attorney, Agent, or Firm*—Charles S. Cohen

[57] ABSTRACT

An electrical connector is adapted for mounting on a surface of a printed circuit board. The connector includes a dielectric housing mounting electrical terminals, with the housing being adapted for mounting on the surface of the board and the terminals establishing electrical connection to appropriate circuit means on the board. A hold-down clip is mounted on the housing and includes a leg portion projecting through a hole in the board with a hooked latch for engaging an opposite side of the board to secure the connector to the board. The hold-down clip is configured such that the leg portion is spring loaded to bias the hooked latch against the opposite side of the board and thereby accommodate printed circuit boards of varying thicknesses. A method of using such hold-down clip is also disclosed.

11 Claims, 5 Drawing Sheets

HOLD-DOWN CLIP FOR BOARD MOUNTED ELECTRICAL CONNECTOR AND METHOD OF USE

FIELD OF THE INVENTION

This invention generally relates to the art of electrical connectors and, particularly, to a hold-down clip for an electrical connector mounted on a surface of a printed circuit board, and including means for accommodating boards having varying thicknesses.

BACKGROUND OF THE INVENTION

Surface-mounted electrical connectors most often have some form of hold-down means for securing the connector to a surface of a printed circuit board or the like. The hold-down means may be provided for permanent securement of the connector or for temporarily maintaining the connector during reflow or wave soldering procedures for permanently interconnecting terminals of the connector with circuit traces on the board. Such hold-down means may be provided by mounting pegs which are integral with the connector housing or by separate hold-down devices or clips. A typical arrangement is to provide the mounting pegs or clips with a bifurcated configuration, along with outwardly projecting hooks or barbs for engaging the opposite surface of the printed circuit board, whereby the pegs or clips can be yieldingly inserted through holes in the board and snappingly engage the opposite side of the board to hold the connector onto the one surface of the board.

One of the problems with hold-down means of the character described above, is associated with the fact that the thickness of a given circuit board may vary, if for no other reason than simple manufacturing tolerances. Consequently, although the electrical connector may be held onto the surface of the printed circuit board, if the board is too thin, the securement may not be sufficiently tight to maintain reliable interengagement between the terminals means of the connector and the circuit traces or solder pads of the printed circuit board which, in turn, will result in unreliable solder connections. In other words, during a reflow or wave soldering process, it is desirable to have the terminal means of the connector to be in steady engagement with the solder pads of the printed circuit board. If a loose securement of the connector with the board is effected by the particular hold-down means, these electrical interconnections often are unreliable or, in fact, defective. In the alternative, the solder joints may initially be reliable, but subsequently fail due to stresses incurred because the hold-down means did not securely hold the connector to the board.

Prior art mounting pegs which are integral with a connector housing do not solve the problem identified above, as associated with printed circuit boards of varying thicknesses. Consequently, separate hold-down means, such as screws or bolts often have been employed to hold a connector securely to the surface of the printed circuit board. However, such means as screws or bolts involve separate or additional assembly steps which are not very cost effective and may be difficult to perform in compact high-density environments.

It would be desirable to provide a hold-down means which is effective in response to a simple mounting procedure, such as with conventional bifurcated/-hooked mounting pegs, but which can accommodate printed circuit boards of varying thicknesses. This invention is directed to that end and to solving the problems identified above.

SUMMARY OF THE INVENTION

An object, therefore, of the invention is to provide a new and improved hold-down means for mounting an electrical connector on a surface of a printed circuit board.

In the exemplary embodiment of the invention, the connector includes a dielectric housing mounting electrical terminal means, with the housing being adapted for mounting on the surface of the printed circuit board and with the terminal means establishing electrical connection to appropriate circuit means on the board. A hold-down clip is mounted on the housing and includes a leg portion projecting through a hole in the board, the leg portion being bifurcated and having hook-like latch means for engaging an opposite side of the board to secure the connector to the board. As disclosed herein, the connector is elongated, and one of the hold-down clips is provided at each opposite end of the housing.

The invention contemplates an improved hold-down clip which includes means for spring loading the leg portion of the clip to bias the latch means against the opposite side of the board. Therefore, printed circuit boards of varying thicknesses can be accommodated.

In the preferred embodiment of the invention, the hold-down clip is provided as a one-piece stamped and formed sheet metal component including an anchoring leg portion securing the clip to the housing, with the spring loaded leg portion projecting from the anchoring leg portion and being flexingly movable relative thereto.

More particularly, the hold-down clip is generally U-shaped with the anchoring leg portion and the spring leg portion forming the legs of the U-shape joined by a bight portion. The bight portion includes a fulcrum section abutting a surface of the housing and a flexing section spaced from the housing, the spring leg portion projecting from the flexing section.

Still further, the latch means on the spring leg portion is provided by hook means for engaging the opposite side of the printed circuit board, and the spring leg portion is bifurcated to yield when inserted into a hole in the printed circuit board. Lastly, the anchoring leg portion may include a solder tab for interengagement with a solder pad on the surface of the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
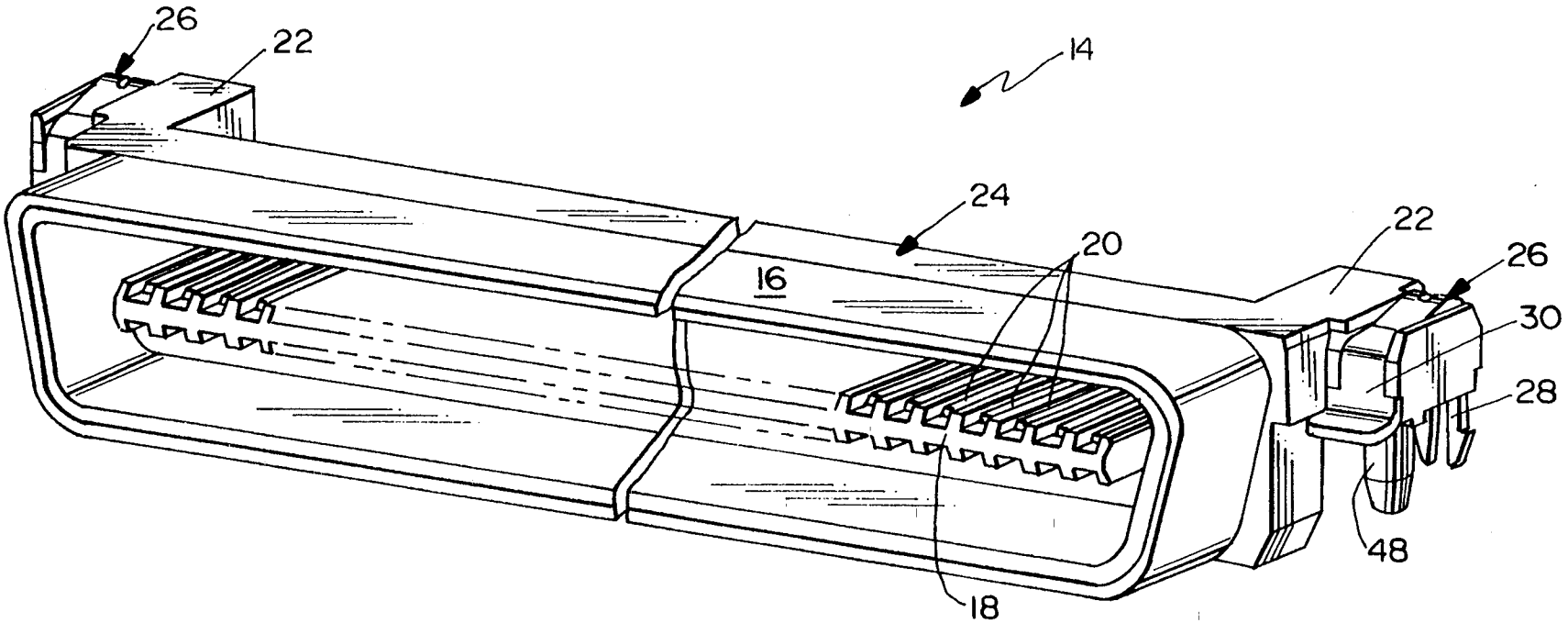
FIG. 1 is a perspective view of an electrical connector embodying the concepts of the invention.

Referring to the drawings in greater detail, and first to FIGS. 1 and 2, the invention is embodied in an electrical connector, generally designated 14, which is adapted for mounting on a surface 52 of a printed circuit board, as will be seen hereinafter. The connector is of a conventional input/output arrangement which includes a shroud-like elongated mating end 16 having a blade-like plug therewithin for mounting the contact portions 20 of appropriate terminal means on the connector, the contact portions provide electrical interconnection with contact means of an appropriate mating connector (not shown). The terminal means include tail portions (not shown) for interconnection with appropriate circuit traces on the printed circuit board, all of which is conventional with such input/output connectors. Lastly, the connector includes wing portions 22 at opposite ends of shroud portion 16. The shroud portion and wing portions all are formed by a unitary dielectric housing, generally designated 24, which may be molded of plastic material. The invention is directed to the provision of at least one hold-down means in the form of a hold-down clip, generally designated 26, mounted on housing 24 for mounting connector 14 to a surface of a printed circuit board. In the preferred embodiment of the invention, one hold-down clip 26 is provided at each opposite end of connector housing 24, on opposite wing portions 22.

Figure 2:
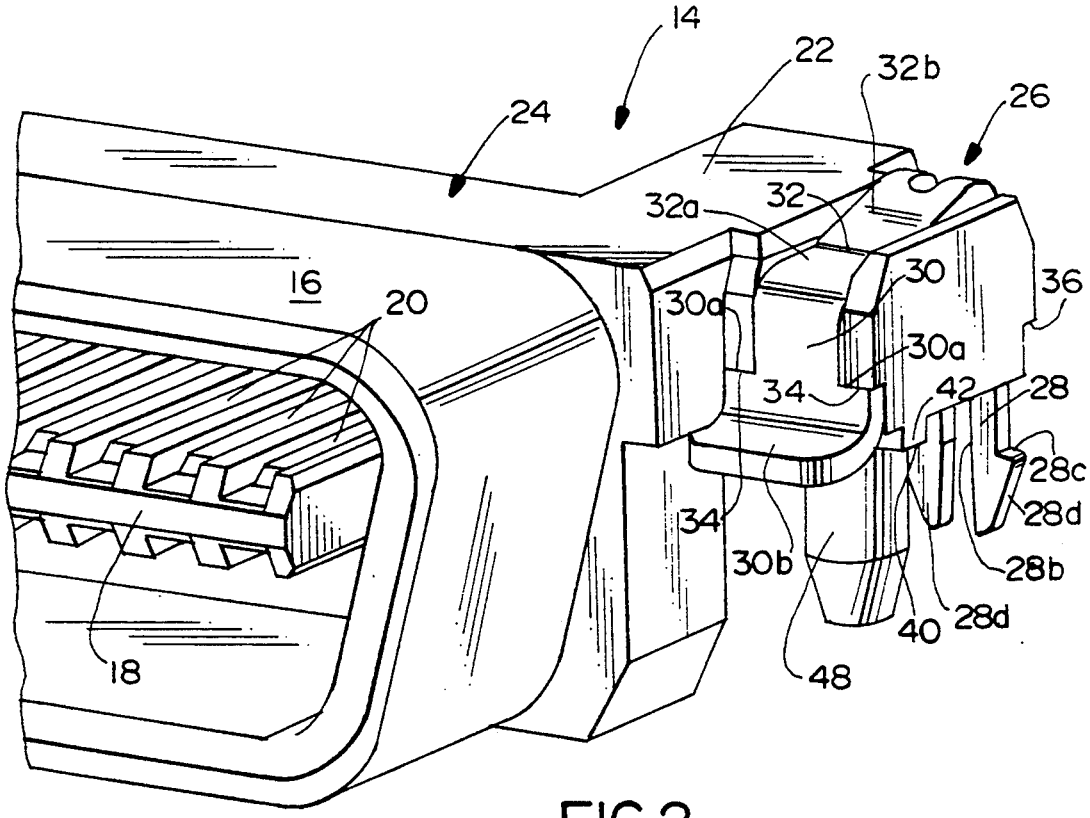
FIG. 2 is an enlarged perspective view of one end of the connector, the right end as viewed in FIG. 1.
Figure 3:
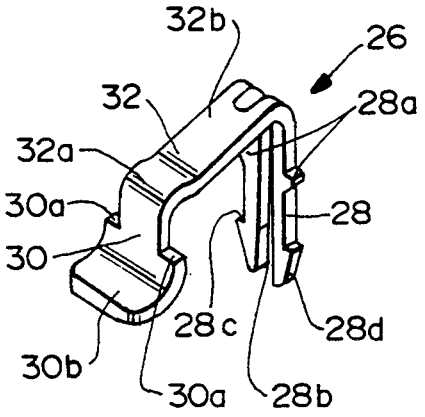
FIG. 3 is a perspective view of one of the hold-down clips of the invention.
Figure 4:
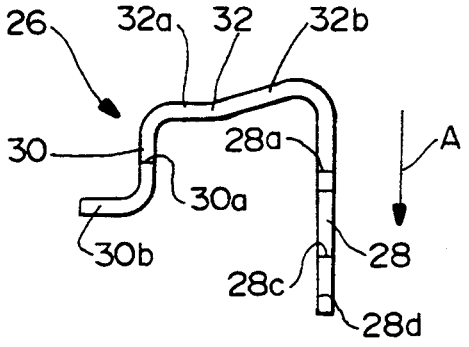
FIG. 4 is a side elevational view of the clip of FIG. 3.
Figure 5:
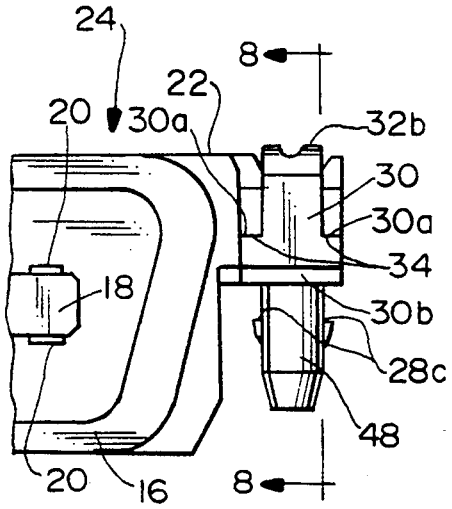
FIG. 5 is a front elevational view of the end of the connector shown in FIG. 2.

Referring to FIGS. 3 and 4 in conjunction with FIGS. 1 and 2, each hold-down clip 26 is provided as a one-piece member stamped and formed from sheet metal material in a generally U-shaped configuration. Specifically, the clip includes a spring loaded leg portion 28 and an anchoring leg portion 30 forming the legs of the generally U-shaped configuration, the legs being joined by a bight portion 32. Each clip 26 engages a respective wing portion 22 of connector housing 24 in an anchored, unstressed condition as shown in FIG. 2. In this condition, a pair of shoulders **30*a* of anchoring leg portion 30 interengage with a pair of shoulders 34 of the connector housing. Similarly, a pair of barbs 28*a* of spring leg portion 28 interengage with shoulders 36** of the connector housing as also seen in FIG. 6 to preload the spring leg if desired.

Figure 8:
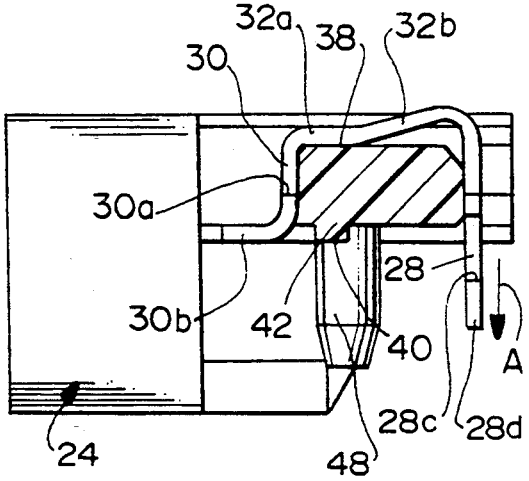
FIG. 8 is a vertical section taken generally along line 8—8 of FIG. 5.

Still referring to FIGS. 3 and 4, spring leg portion 28 is bifurcated, by means of a slot **28*b*, and hook-like latch projections 28*c* extend outwardly from the spring leg portion. Anchoring leg portion 30 includes an outwardly projecting solder tab or fitting nail 30*b*. Bight portion 32 includes a fulcrum section 32*a* which abuts against a surface 38 (see FIG. 8) of the connector housing when the hold-down clip is in its preloaded condition. A flexing section 32*b* of the bight portion is cantilevered upwardly away from housing surface 38 so as to be spaced therefrom. Therefore, it can be seen that spring leg portion 28 projects or depends from flexing section 32*b*, whereby downward movement of the flexing section allows the leg portion 28 to move in the direction of arrow "A" (FIG. 4) until the lower surface of flexing leg 32*b* engages housing surface 38. The lower portion 28*d* of spring leg portion 28 has inclined or tapered lead-in surfaces to guide the spring leg portion into a hole 49 in a printed circuit board 44**.

Figure 6:
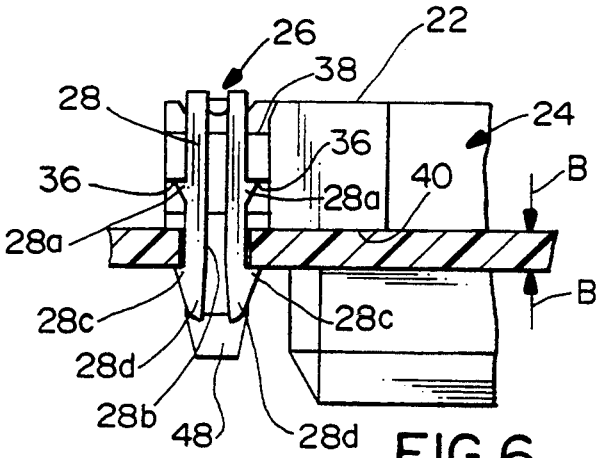
FIG. 6 is a rear elevational view of the end of the connector shown in FIGS. 2 and 5.
Figure 7:
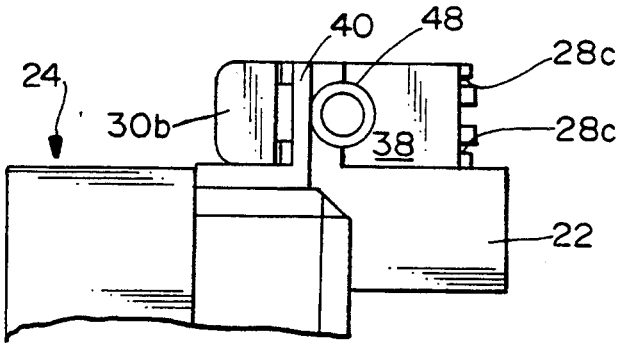
FIG. 7 is a bottom plan view of the end of the connector shown in FIGS. 2, 5 and 6.

Recapitulating, reference can be made to FIGS. 5–8 in conjunction with FIGS. 1–4, and it can be understood that anchoring leg 30 of each clip 26 secures the clip on the connector housing, as fulcrum section **32*a* of bight portion 32 of the clip firmly engages surface 38 (FIG. 8) of the connector housing. However, leg portion 28 of the clip is free to flex in the direction of arrow "A", because flexing section 32*b* of bight portion 32 is spaced from surface 38. On the other hand, when in its preloaded condition, leg portion 28 cannot move opposite the direction of arrow "A", because of the interengagement of barbs 28*a* with housing shoulders 36** as best seen in FIG. 6.

In this preloaded or undeflected condition as described above and shown in FIGS. 2–8, a distance is defined by the hooked latch means **28*c* of spring leg portion 28 and a bottom surface 40 of connector housing 24 which is the surface of the connector that engages the top surface 52 of a printed circuit board 44. Actually, surface 40 is provided only by wing portions 22 of the connector housing and the bottom surface of standoffs 42 (FIG. 2) of the wing portions. This distance is indicated by arrows "B" in FIG. 6. This distance should be the minimum thickness of any given printed circuit board when taking into consideration all manufacturing tolerances. As an example only, if a printed circuit board is intended to be 1.00 mm thick, $\pm 0.10$ mm, the distance defined by arrows "B" between hooked latch means 28*c* and surface 40 should be on the order of 0.90 mm. Therefore, in its preloaded or undeflected condition, hold-down clip 26** can securely accommodate the minimum expected thickness of the printed circuit board.

Figure 9:
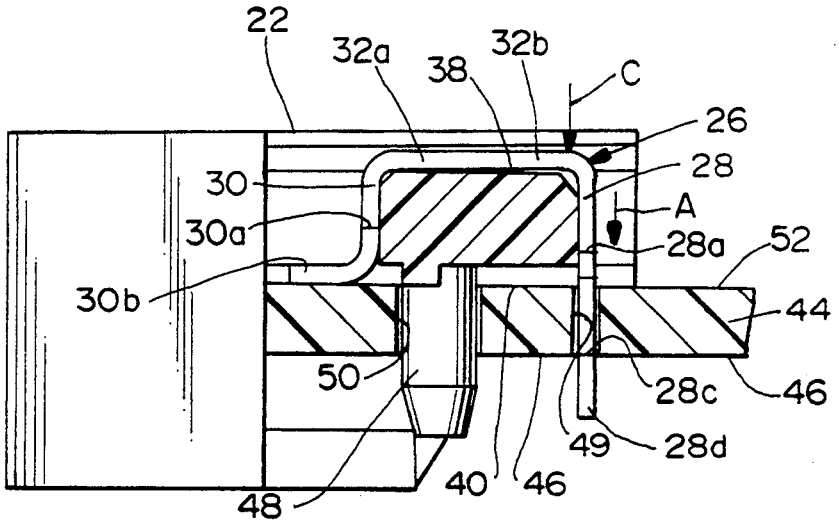
FIG. 9 is a view similar to that of FIG. 6, but showing the connector mounted to a printed circuit board, with the mounting clip in its spring biased condition.
Figure 10:
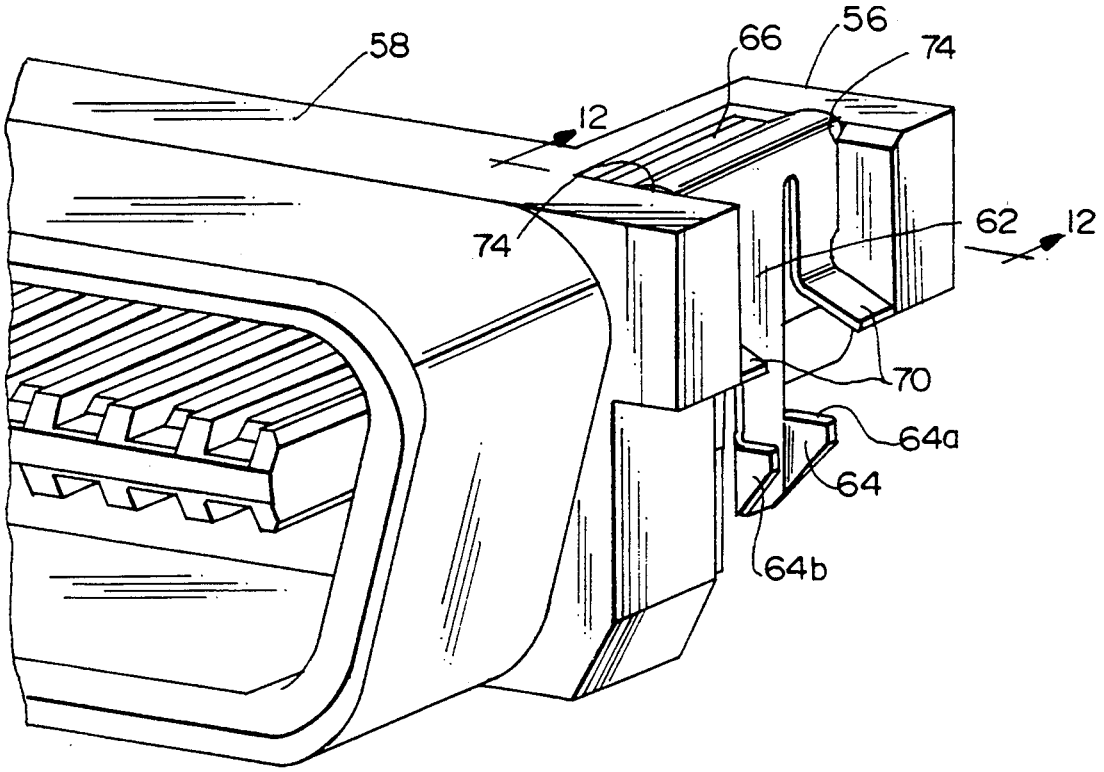
FIG. 10 is a perspective view of an electrical connector, similar to that of FIG. 2, but illustrating an alternate form of hold-down clip.

Now, referring to FIG. 9, a printed circuit board 44 is shown of a thickness greater than that described above. However, it can be seen that spring leg portion 28 is positioned further downwardly or through a hole 49 in the printed circuit board so that hooked latch means **28*c* engages an opposite side 46 of the board. The gap between flexing section 32*b* of the clip and housing surface 38** can be seen to be smaller than that shown in FIG. 8.

In mounting electrical connector 14 to a printed circuit board, the connector is properly located on the board, such as by the use of mounting pegs 48 (FIG. 9) inserted into appropriate holes 50 in the printed circuit board. Surface 40 on the underside of the connector will engage top surface 52 of printed circuit board 40. Unless the printed circuit board is of its minimal expected thickness, taking into consideration all tolerances, hooked latch means 28*c* of spring leg portion 28 will not have latchingly interengaged with the bottom or opposite surface 46 of the board. Force then is applied to flexing section 32*b* of bight portion 32 of the mounting clip in the direction of arrow "C" (FIG. 9). This causes spring leg portion 28 to move in the direction of arrow "A." As the tapered lead-in portion 28*d* of the spring leg portion enters hole 49, the individual legs of the spring leg portion 28 deflect inward to permit the hooked latch projections 28*c* to pass through the hole. Once the projections pass through the hole, the individual legs will snap back so that as the force is removed from flexing section 32*b* and it, along with spring leg portion 28, move back upwards, the hooked latch projections 28*c* will engage the underside 46 of printed circuit board 44 to securely hold the connector 14 to the board. At such time, the tail portions of the terminals as well as solder tabs 30*b* may be surface mounted to the printed circuit board through a solder re-flow process as is known in the art.

In the preferred embodiment, the orientation of the hold-down clip 26 relative to the rest of the connector is significant. In use, when mounted on a circuit board, the connector may be rocked up and down or from side to side in an attempt to disconnect a mating connector. The solder tails of the terminals project rearwardly from housing 24 between wing portions 22 and the present configuration is designed to reduce stresses on the solder joints of these tails. Mounting pegs 48 primarily serve to position the connector on the printed circuit board rather than firmly secure the connector thereon. These pegs, however, will still resist rocking of the connector from side to side in order to reduce stresses on the solder tail/printed circuit board solder joints. The spring leg portion 28 locked beneath board 44 will resist downward rotation of the connector 14. By including solder tab 30*b* which is positioned forward of the solder tail/printed circuit board interconnection, the solder tabs rather than the solder tails of the terminals endures the stresses caused by upward rocking of the connector.

FIGS. 10–13 show an alternate embodiment of the invention wherein a hold-down clip, generally designated 56, is mounted on a connector housing 58 for securing the connector to a printed circuit board 60 (FIG. 12) having a top surface 60*a* and a bottom surface 60*b*.

Hold-down clip 56 includes a resilient leg 62 having a tapered latch projection 64 for engaging bottom surface 60*b* of the printed circuit board 60. Latch projection 64 is formed by bending a pair of wings 64*b* out of the plane of leg 62. Tongue 66 engages a surface 68 of connector housing 58. A pair of tabs 70 engage top surface 60*a* of the printed circuit board. Outwardly projecting barbs 72 (FIG. 11) may be used to skive into the material of the connector housing within grooves 74 (FIG. 10) to hold the clip in the connector housing.

Figure 11:
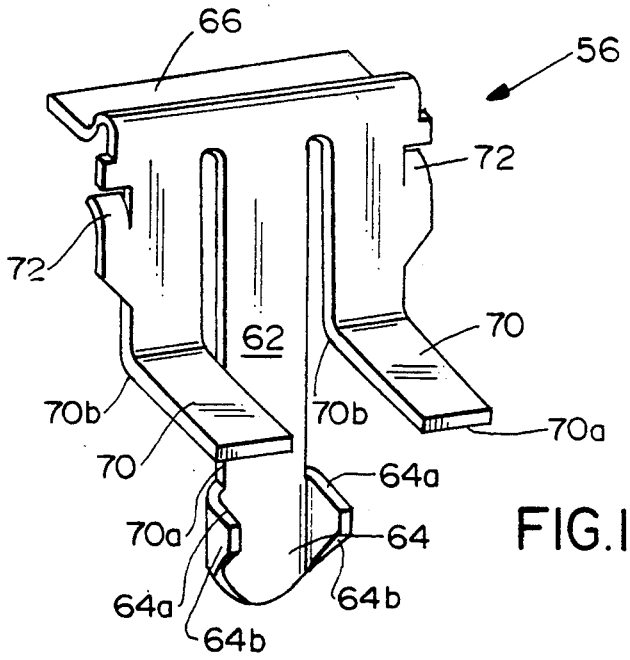
FIG. 11 is a perspective view of the one of the hold-down clips shown in FIG. 10.
Figure 12:
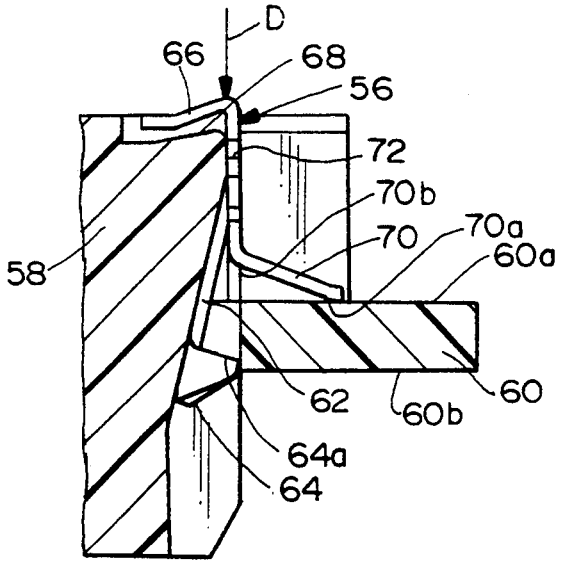
FIG. 12 is a fragmented vertical section through the right-hand end of FIG. 10, showing the clip associated with a printed circuit board.
Figure 13:
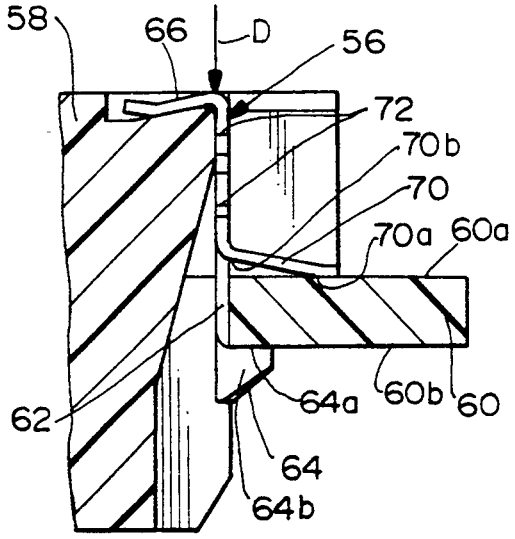
FIG. 13 is a view similar to that of FIG. 12, with the clip in its spring biased, hold-down condition.

In operation, hold-down clips 56 are positioned so that tongue 66 is positioned above surface 68. Upon placing the connector on the circuit board 60, tapered latch projection 64 rides along the edge (outer periphery) of the printed circuit board or within a hole causing resilient arm 62 to deflect as shown in FIG. 12. Pressure then is applied to the clip in the direction of arrow "D" to drive the clip downwardly from its preloaded condition shown in FIG. 12 to its fully latched condition shown in FIG. 13 where tapered latch projection 64 snaps into engagement with bottom surface 60*b* of printed circuit board 60. Tabs 70 can be seen in a stressed condition in engagement with top surface 60*a* of the circuit board, to sandwich the board securely between the tabs and tapered latch projection 64, thereby securing the connector to the board. Again, it can be seen that the structure of hold-down clip 56 in FIGS. 10–13 accommodates printed circuit boards of varying thickness and, like hold-clip 26, is effective and made functional by the simple action of mounting the connector onto the printed circuit board and applying pressure to the clip, all of which can be performed by a unitary manual motion, versus additional mounting or assembly steps of much of the prior art. Thus, hold-down clip 56 will secure circuit boards of varying thicknesses, ranging from a minimum thickness equal to the vertical distance between the top surface 64*a* of hooked latch projection 64 to the distal end 70*a* of tabs 70 when in their undeflected condition as shown in FIG. 11 to a maximum thickness equal to the distance from the top surface 64*a* of hooked latch projection 64 to the proximal end 70*b* of tabs 70.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting on a surface of a circuit board comprising:

a dielectric housing having electrical terminal means, the housing being adapted for mounting on the surface of the board with the terminal means establishing electrical connection to appropriate circuit means on the board, and a stamped and formed hold-down clip mounted on the housing and including a solder tab for mounting to a surface of the circuit board, an anchoring leg portion for securing the clip to the housing, and a spring loaded leg portion projecting from the anchoring leg portion and being flexing movable relative thereto, said spring loaded leg portion being adapted to project through a hole in the board with latch means for engaging an opposite side of the board to secure the connector to the board, said hold-down clip including means for spring loading said leg portion so as to permit said leg portion to travel in a direction perpendicular to said circuit board relative to said housing when in its operational position on said housing and to bias said latch means against the opposite side of the board and thereby accommodate printed circuit boards of varying thicknesses, wherein said hold-down clip is generally U-shaped with said anchoring leg portion and said spring loaded leg portion comprising the legs of the U-shape joined by a bight portion, the bight portion including a fulcrum section abutting a surface of the housing and a flexing section spaced from the housing, the spring loaded leg portion projecting from the flexing section.

2. In an electrical connector as set forth in claim 1, wherein said housing is elongated and including one of said hold-down clips at each opposite end of the housing.

3. In an electrical connector as set forth in claim 1, wherein said latch means comprise outwardly projecting hook means for engaging the opposite side of the printed circuit board.

4. In an electrical connector as set forth in claim 3, wherein said spring loaded leg portion is bifurcated.

5. An electrical connector for mounting on a surface of a generally planar printed circuit board having opposed surfaces, the connector comprising:

an elongate dielectric housing having conductive terminals therein; and a one-piece, stamped and formed hold-down clip mounted on the housing adjacent each end thereof, each hold-down clip including an anchoring leg portion securing the clip to the housing, a portion of a locking leg adapted to project past both surfaces of the printed circuit board with latch means for engaging an opposite side of the board to secure the connector to the board and spring loading means between said anchoring leg and said latch means for spring loading said locking leg to bias said latch means in said direction perpendicular to the plane of the board and against the opposite side of the board to thereby accommodate printed circuit boards of varying thicknesses, said locking leg of each said hold-down clip being movable relative to said housing in a direction perpendicular to the plane of the circuit board and wherein said spring loading means biases said locking leg against a portion of said housing.

6. In an electrical connector as set forth in claim 5, wherein said latch means comprises outwardly projecting hook means for engaging the opposite side of the printed circuit board.

7. In an electrical connector as set forth in claim 5, wherein said spring loaded locking leg is bifurcated.

8. In an electrical connector as set forth in claim 5, wherein said hold-down clip further includes a generally planar solder tab for soldering to the surface of the circuit board.

9. An electrical connector for mounting on a surface of a generally planar printed circuit board having opposed surfaces, the connector comprising:

an elongate dielectric housing having conductive terminals therein; and a one-piece, stamped and formed hold-down clip mounted on the housing adjacent each end thereof, each hold-down clip including an anchoring leg portion securing the clip to the housing, a portion of a locking leg adapted to project past both surfaces of the printed circuit board with latch means for engaging an opposite side of the board to secure the connector to the board and spring loading means between said anchoring leg and said latch means for spring loading said locking leg to bias said latch means in said direction perpendicular to the plane of the board and against the opposite side of the board to thereby accommodate printed circuit boards of varying thicknesses, said locking leg of each said hold-down clip being movable relative to said housing in a direction perpendicular to the plane of the circuit board and wherein said hold-down clip is generally U-shaped with said anchoring leg portion and said spring loaded leg portion comprising the legs of the U-shape joined by a bight portion, the bight portion including a fulcrum section abutting a surface of the housing and a flexing section spaced from the housing, the spring loaded locking leg projecting from the flexing section.

10. In an electrical connector as set forth in claim 9 wherein said spring loading means biases said locking leg against a portion of said housing.

11. In an electrical connector as set forth in claim 9, wherein said latch means comprises outwardly projecting hook means for engaging the opposite side of the printed circuit board.

* * * * *